US010486454B2

(12) United States Patent
Warwick

(10) Patent No.: US 10,486,454 B2
(45) Date of Patent: Nov. 26, 2019

(54) BACKGROUND IMAGE SECURITY FEATURE

(71) Applicant: DATACARD CORPORATION, Minnetonka, MN (US)

(72) Inventor: Dennis J. Warwick, Richfield, MN (US)

(73) Assignee: ENTRUST DATACARD CORPORATION, Shakopee, MN (US)

( * ) Notice: Subject to any disclaimer, the term of this patent is extended or adjusted under 35 U.S.C. 154(b) by 379 days.

(21) Appl. No.: 14/207,922

(22) Filed: Mar. 13, 2014

(65) Prior Publication Data

US 2015/0258836 A1 Sep. 17, 2015

(51) Int. Cl.

| | |
|---|---|
| ***B42D 25/30*** | (2014.01) |
| ***B42D 25/41*** | (2014.01) |
| ***B42D 25/20*** | (2014.01) |
| ***B41M 3/14*** | (2006.01) |

(52) U.S. Cl.

CPC ..... *B42D 25/30* (2014.10); *B42D 25/41* (2014.10)

(58) Field of Classification Search

CPC ..... B42D 15/00; B42D 15/10; B42D 25/30; B42D 25/20; B42D 25/41; G09C 3/00; B41M 3/14

USPC ..... 283/72, 74, 93, 94, 98, 901

See application file for complete search history.

(56) References Cited

U.S. PATENT DOCUMENTS 4,404,764 A * 9/1983 Wills ..... B42D 15/02 40/124.11
5,850,481 A * 12/1998 Rhoads ..... H04N 1/32251 382/181
6,179,338 B1 1/2001 Bergmann et al.
8,528,941 B2 9/2013 Dorfler et al.
2004/0232691 A1 11/2004 Lazzerini
2005/0095408 A1 5/2005 LaBrec et al.
2008/0111877 A1* 5/2008 Heyse ..... B41J 3/32 347/220
2008/0284157 A1* 11/2008 Muke ..... B41M 3/14 283/86
2009/0251749 A1* 10/2009 O'Boyle ..... G03H 1/0252 283/86

(Continued)

FOREIGN PATENT DOCUMENTS

| | | | |
|---|---|---|---|
| CN | 1128006 | A | 7/1996 |
| CN | 1202134 | A | 12/1998 |
| CN | 1545079 | A | 11/2004 |
| CN | 101556752 | A | 10/2009 |

(Continued)

OTHER PUBLICATIONS

European Search Report, issued in the corresponding European patent application No. 15158745.8, dated Sep. 21, 2015, 9 pages.

(Continued)

*Primary Examiner* — Justin V Lewis
(74) *Attorney, Agent, or Firm* — Hamre, Schumann, Mueller & Larson, P.C.

(57) ABSTRACT

A security document and a method for producing a security document are described. The security document includes a plurality of spaced spots integrally formed in the security document. The plurality of spaced spots and printed data overlap. The spaced spots are arranged to form an image. The method includes controlling a laser of a laser marking printer to integrally form the plurality of spaced spots in the security document. The plurality of spaced spots and printed data overlap on the security document.

16 Claims, 6 Drawing Sheets

(56) References Cited

U.S. PATENT DOCUMENTS

| | | | | |
|---|---|---|---|---|
| 2010/0007130 | A1* | 1/2010 | Komarek | B41M 3/14 283/72 |
| 2010/0164216 | A1* | 7/2010 | Fracek | B42D 25/29 283/72 |
| 2014/0361527 | A1 | 12/2014 | Lazzari et al. | |

FOREIGN PATENT DOCUMENTS

| | | | |
|---|---|---|---|
| CN | 103201118 | A | 7/2013 |
| WO | 9415319 | | 7/1994 |
| WO | 2005062978 | | 7/2005 |
| WO | 2007128426 | | 11/2007 |
| WO | 2013093230 | | 6/2013 |
| WO | 2014033356 | | 3/2014 |

OTHER PUBLICATIONS

U.S. Appl. No. 14/180,045, filed Feb. 13, 2014 (20 pages).
Office Action (with partial English translation) issued in CN201510109384.5, dated Jun. 26, 2017, 12 pages.

* cited by examiner

BACKGROUND IMAGE SECURITY FEATURE

FIELD

Embodiments of this disclosure relate generally to a security feature on a substrate, such as a security document. More specifically, the embodiments relate to creating a background image security feature on a security document using a laser.

BACKGROUND

A security document (e.g., a plastic card, document, passport, or the like) generally includes a substrate with printed data. A security document can, for example, include an identification card/certificate, a driver's license, a membership card, a financial card (e.g., a credit card, a debit card), a phone card, a health card, a passport, or the like. Printed data including, for example, a home address, a birthdate, a name, a portrait image, and/or other identifying information can be printed on the security document. The security document can also include a security feature (e.g., a hologram) to deter counterfeiters from modifying or reproducing the security document.

SUMMARY

Embodiments of this disclosure relate generally to a security feature on a substrate, such as a security document. More specifically, the embodiments relate to creating a background image security feature on a security document using a laser.

A security document can include any one of a variety of plastic cards, documents, or a passport that one may wish to protect the authenticity of using a security feature. Examples of security documents include, but are not limited to, a financial card (e.g., a credit card, a debit card, or the like), a driver's license, an identification card/certificate, a passport, or the like. Security documents can include printed data and a background image security feature.

The background image security feature can be produced with a laser (e.g., a laser of a laser marking printer). The background image security feature and the printed data can overlap each other.

The background image security feature can cover from about 10% to about 50% of a surface of a security document. In one embodiment, the background image security feature can cover from about 20% to about 40% of a surface of the security document. In another embodiment, the background image security feature can cover more than 25% of a surface of the security document.

In one embodiment, the background image security feature is generated from variable data (e.g., a portrait image of the security document holder, a birthdate of the security document holder, or the like). When viewed under a microscope, the background image security feature appears as a plurality of spots produced by the laser marking. In another embodiment, when viewed under a microscope, the background image security feature appears as a gray area without distinct spots.

In one embodiment, the spots are dots or any other shape created by the laser which results in formation of the background image security feature.

In one embodiment, the background image security feature is created on a security document prior to adding printed data. In another embodiment, the printed data is added to a security document prior to creating the background image security feature.

In one embodiment, the power of the laser is adjusted to create at least some of the spots using different laser powers.

In one embodiment, the background image security feature is a portrait image. In another embodiment, the background image security feature is a portrait image of the intended document holder. In another embodiment, the background image security feature is a portrait image other than of the intended document holder.

In one embodiment, the background image security feature is one or more alphanumeric characters.

In one embodiment, the security document is a plastic card or a passport.

A security document and a method for producing a security document are described. The security document includes a plurality of spaced spots integrally formed in the security document. The plurality of spaced spots and printed data overlap. The spaced spots are arranged to form an image. The method includes controlling a laser of a laser marking printer to integrally form the plurality of spaced spots in the security document. The plurality of spaced spots and printed data overlap on the security document.

BRIEF DESCRIPTION OF THE DRAWINGS

References are made to the accompanying drawings that form a part of this disclosure and which illustrate the embodiments in which the systems and methods described in this Specification can be practiced.

Like reference numbers represent like parts throughout.

DETAILED DESCRIPTION

Figure 1A:
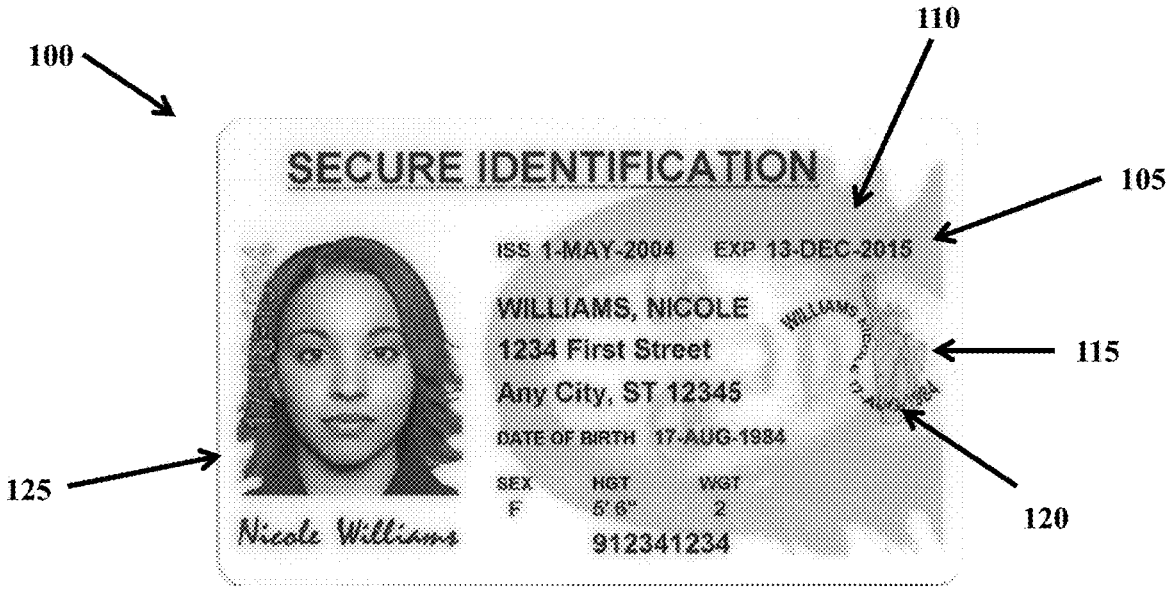
FIGS. 1A and 1B illustrate a security document including a background image security feature, according to one embodiment.

Improved security documents can include printed data (such as, but not limited to, a name, an address, or the like) and a background image security feature (such as, but not limited to, a portrait image, alphanumeric text, or the like) that overlaps with at least a portion of the printed data. Overlapping at least a portion of the printed data with a background image security feature can make it difficult to substitute and/or add information to a security document, which aids in protecting the authenticity of the security document. In some embodiments, the security document can include a core and a laser reactive material or layer attached to the core. An optional protective layer can be included so that the laser reactive material is positioned between the core and the protective layer. In one embodiment, the background image security feature and a surface of the security document have a one-piece construction (for example, the background security feature is integrally formed in the laser reactive layer) and can include a plurality of spaced spots that are arranged to form an image. In some embodiments, the spaced spots are formed by a laser, which can add forensic security characteristics to the security document. More specifically, the use of a laser to form the background security feature can facilitate the formation of "microscopic bumps" that can be seen under magnification in reflected light. The formation of microscopic bumps, which in some embodiments cannot be felt or detected by touch (non-tactile), can aid in the identification of forged documents since the microscopic bumps will not be present when a background image is formed by methods such as inkjet or thermal transfer printing.

In some embodiments, a background image security feature can cover from about 10% to about 50% of a surface of a security document. In other embodiments the background image security feature can cover from about 20% to about 40% of a surface of the security document. In further embodiments, the background image security feature can cover more than 25% of a surface of the security document.

A security document can include any one of a variety of plastic cards, documents, or a passport that one may wish to protect the authenticity of using a security feature. Examples of security documents include, but are not limited to, a financial card (e.g., a credit card, a debit card, or the like), a driver's license, an identification card/certificate, a passport, or the like. Security documents can include printed data.

Printed data on a security document can include, for example, alphanumeric text or characters, images, or combinations thereof. For example, a security document can include variable data (e.g., variable from one security document to the next) that is personal to an intended holder of the security document. Examples of variable data include, but are not limited to, a home address, a name, a portrait image (e.g., a photograph), and other identifying information. Variable data can similarly be referred to as personalization information. The variable data can be personal to an individual for whom the security document is printed, randomly generated, related to the card issuer, or the like. The printed data can also include fixed or non-variable data that may appear on multiple security documents and is not personal to the intended holder of the security document. Examples of non-variable data include, but are not limited to, a government entity name, a name of the document issuer, a company logo, a general security logo, or the like.

Printed data can be applied to a security document using any of a variety of printing methods. Examples of printing methods include, but are not limited to, laser marking, thermal transfer, dye sublimation, inkjet, offset gravure, or other similar printing methods.

Security documents generally also include one or more security features such as, but not limited to, holograms, micro printing, or the like. The one or more security features are designed to prevent counterfeiting or modification of the security documents. Some security features can be undetectable unless viewed under a microscope, a special light, or the like. For example, a security feature may only be detectable when the security document is viewed under a black light.

Embodiments of this disclosure are directed to a background image security feature that is created using a laser. The background image security feature for the security document can be produced with a laser in a laser marking printer. The background image security feature can include a plurality of spaced spots arranged to form an image. When viewed under magnification, the individual spots are discernable. When viewed without magnification, the individual spots are not discernable. In one embodiment, when viewed under magnification the background image security feature can appear differently than when viewed without magnification. For example, under magnification the image of the background image security feature may not be identifiable (e.g., if the image is a logo, the logo may not be identifiable until viewed without magnification).

In one embodiment, the background image security feature is laser marked and serves as a background to at least a portion of the printed data on the security document. In one embodiment, the background image security feature is generated from variable data (e.g., a portrait image of the security document holder, a birthdate of the security document holder, or the like). In another embodiment, the background image security feature is generated from non-variable data (e.g., a portrait image, phrase, or the like).

An image is not limited to a portrait image. Examples of images include, but are not limited to, one or more partial or complete portraits, one or more alphanumeric characters, one or more symbols, one or more logos, one or more phrases, or combinations thereof.

A "microscopic bump" includes, for example, a bump which will be visible under magnification in reflected light. In one embodiment, a microscopic bump can be tactile. While in another embodiment, a microscopic bump can be non-tactile.

A "non-tactile microscopic bump" includes, for example, a bump that cannot be sensed/felt by touch (e.g., feels smooth to the touch), but which will be visible under magnification in reflected light.

A "tactile microscopic bump" includes, for example, a bump that can be sensed/felt by touch and will be visible under magnification in reflected light.

A "spot" includes, for example, a microscopic bump integrally formed in a security document using a laser. In one embodiment, the microscopic bump can be integrally formed in a laser reactive material layer of the security document. In such an embodiment, the microscopic bump and the laser reactive material layer have an integrated one-piece construction. It is to be appreciated that integrally formed in can alternatively be described as integrally formed with, integrally formed on, or the like.

Figure 1B:
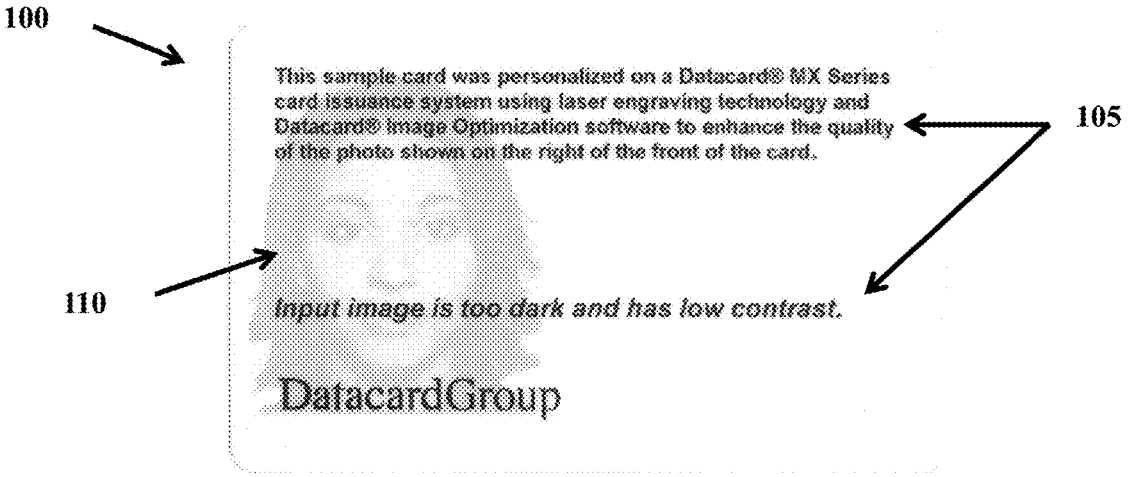

FIGS. 1A and 1B illustrate a security document 100 including a background image security feature 110. The illustrated security document 100 is an identification card and can, for example, represent a plastic identification card, according to one embodiment. A plastic identification card is discussed by way of example in this Specification. The embodiments, aspects, and concepts described in this Specification can also apply to security documents other than plastic cards, such as, for example, documents or passports.

FIG. 1A illustrates the security document 100 including the background image security feature 110 disposed on a front side of the security document 100. FIG. 1B illustrates the security document 100 including the background image security feature 110 disposed on a backside of the security document 100.

In one embodiment, the front and back sides of the security document 100 both include the background image security feature 110. In another embodiment, the security document 100 includes the background image security feature 110 on either the front side or the backside, but not both. The illustrated embodiment shows the front side and the backside of the security document 100 as having the same background image security feature 110. In one embodiment, the background image security feature 110 on the front side of the security document 100 can be a different image than the background image security feature 110 on the backside of the security document 100. In yet another embodiment, the background image security feature 110 can be the same image on the front and back sides of the security document 100 but have different dimensions (similar to the illustrated embodiment), different shading, different orientation, or the like.

In one embodiment, the security document 100 includes printed data 105, security features 115 and 120, and a primary portrait image 125. The printed data 105 can alternatively be referred to as the personalization data 105. All text and images are intended to be exemplary and can be modified. In the illustrated embodiment, the background image security feature 110 is the same image as the primary portrait image 125. In another embodiment, the background image security feature 110 and the primary portrait image 125 can be different images. In yet another embodiment, the background image security feature 110 and the primary portrait image 125 can be different views of the same subject.

Figure 1C:
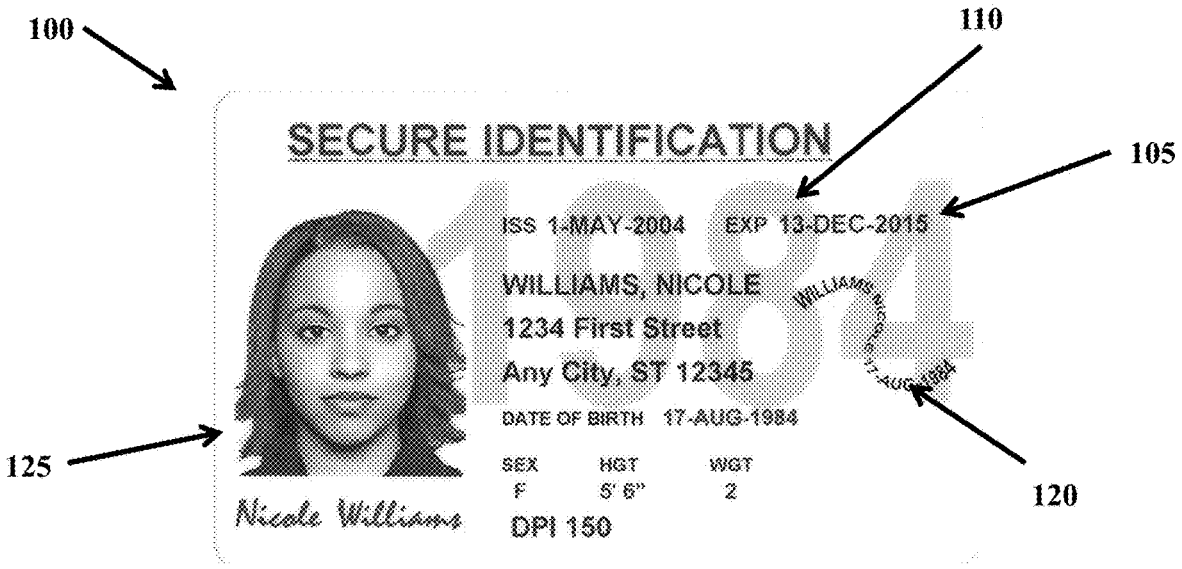
FIG. 1C illustrates a security document including a background image security feature, according to another embodiment.

The background image security feature 110 is formed on the security document 100 such that at least a portion of the printed data 105 and the background image security feature 110 overlap. As used in this Specification, overlap is not intended to necessitate a particular order for the steps of producing the security document 100. In one embodiment, the background image security feature 110 overlaps the printed data 105. In another embodiment, the printed data 105 overlaps the background image security feature 110. The illustrated background image security feature 110 is a portrait image of the intended cardholder. In another embodiment, the background image security feature 110 is a portrait image other than of the intended cardholder. In yet another embodiment, the background image security feature 110 is not a portrait image, but is instead text, such as, but not limited to, a birthdate (e.g., the security document 100 as illustrated in FIG. 1C). Generally, to increase the level of security, the background image security feature 110 is data that is personal to the intended document holder. In one embodiment, the background image security feature 110 is text that does not include personal information, but instead includes different text, such as, but not limited to, text related to the card issuer (e.g., non-variable data), a company logo, randomly generated text that varies from security document to security document, or the like.

The background image security feature 110 may appear differently under magnification depending on whether the background image security feature 110 is added to the security document 100 prior to adding the printed data 105 or after the printed data 105 has been added to the security document 100. Further, the material used for the security document 100 may impact the appearance in addition to the order. In one embodiment, the security document 100 includes a laser reactive material (discussed in further detail in accordance with FIGS. 2A-2C below) having a thickness of about 100 μm. When the printed data 105 is added to the security document 100 prior to the background image security feature 110, the spots (e.g., the spots 320B described in further detail in accordance with FIG. 3 below) are slightly smaller where the background image security feature 110 and the printed data 105 overlap than when the background image security feature 110 is added to the security document 100 prior to the printed data 105. In another embodiment, when the security document 100 includes a laser reactive material having a thickness of about 200 μm, the results may be similar regardless of the order.

In FIG. 1A, the background image security feature 110 is shown in a portrait orientation on the security document 100. As illustrated in FIG. 1B, the background image security feature 110 can be created in a landscape orientation, or otherwise rotated, with respect to other printed data on the security document 100. In another embodiment, the orientation of the background image security feature 110 can be something other than landscape or portrait. For example, the background image security feature 110 can extend diagonally.

The background image security feature 110 can vary in size. Increasing the size of the background image security feature 110 can increase the legibility of the background image security feature 110. A larger background image security feature 110, such as the one in FIG. 1A as compared to in FIG. 1B, may overlap with more of the printed data 105 and other features of the security document 100, which can provide additional security and increase the level of difficulty to produce a duplicate or modified security document with a modified background image security feature 110.

The darkness of the background image security feature 110 can vary. The darkness can be based, for example, on balancing the legibility of the background image security feature 110 and the legibility of the overlapping printed data 105. Further, if the background image security feature 110 is too dark, the overlapping printed data 105 may become tactile. Whether or not the background image security feature 110 is tactile may be dependent on the application. For example, one particular issuer of a security document may want the background image security feature 110 to be tactile, while another issuer may not. The darkness can be defined by a printing resolution and a visual density of the background image security feature 110. In one embodiment, the printing resolution of the security feature 110 can range from about 80 dots per inch (DPI) to about 200 DPI and the visual density (e.g., measured using a spectrophotometer) can range from about 0.2 to about 0.8.

In one embodiment, the background image security feature 110 can be produced such that the image has a varying darkness. For example, the background image security feature 110 can be produced such that a central portion of the image is darker than the outer portion. Other similar variations in the darkness of the background image security feature 110 can provide additional security. In one embodiment, the varying darkness can be a result of a grayscale variation (e.g., see FIG. 4 discussed below) in the background image security feature 110. In another embodiment, the variation can be a result of dithering to vary the spot density. Various algorithms known to one of ordinary skill in the art are available for producing the dithering.

The background image security feature 110 is added to the security document 100 using a laser marking system. Generally, laser marking, and more specifically, laser marking of a security document, is a well-known process. For example, laser marking is implemented in the MX series of card personalization systems available from the DataCard Corporation of Minnetonka, Minn.

Figure 2A:
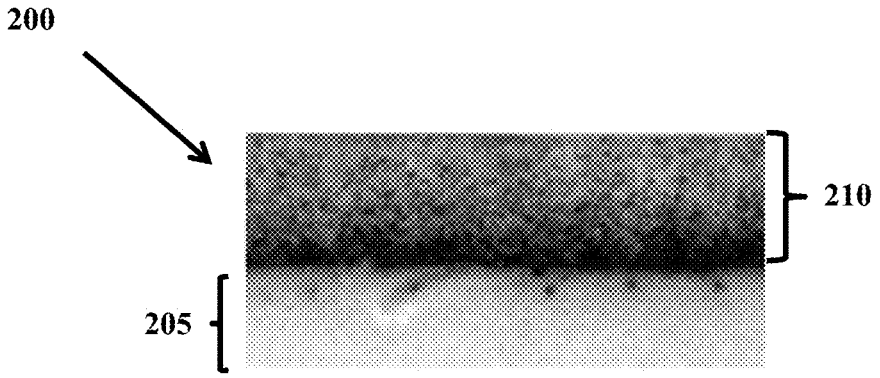
FIG. 2A (PRIOR ART)
FIG. 2A illustrates a side view of a security document including a core and a laser reactive material printed according to a known method.
Figure 2B:
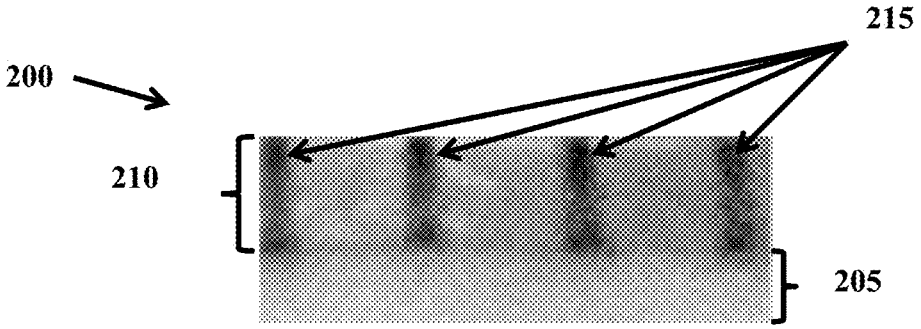
FIGS. 2B-2C illustrate side views of a security document including a core and a laser reactive material, according to one embodiment.
Figure 2C:
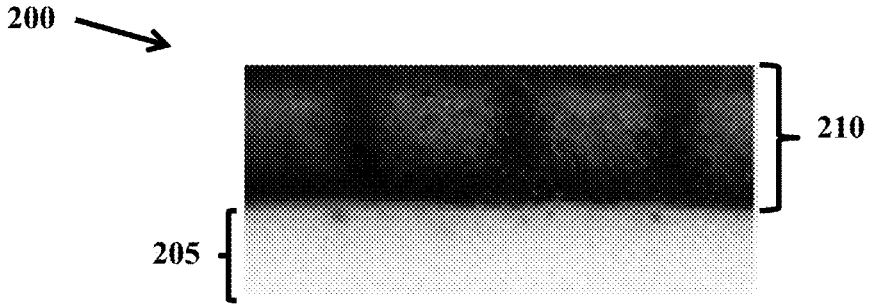
Figure 2D:
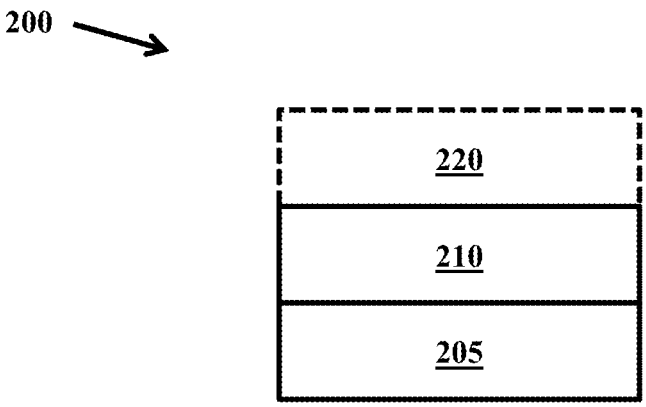
FIG. 2D illustrates a side view of a security document including a core, a laser reactive material, and an optional protective layer, according to one embodiment.

FIGS. 2A-2C illustrate side views of a security document 200 including a core 205 and a laser reactive material 210. FIG. 2D illustrates a side view of the security document 200 including the core 205, the laser reactive material 210, and an optional protective layer 220. The security document 200 in each of the FIGS. 2A-2C illustrates the laser marking in a different portion of the security document.

FIG. 2A illustrates a portion of the security document 200 that includes printed data that does not overlap with a background security feature (e.g., the background security feature 110 of FIG. 1) or a primary portrait image (e.g., the primary portrait image 125 of FIG. 1) applied using a known laser printing method. The side view illustrates that the area near the core 205 is darker than the area near the surface.

In FIG. 2B, the portion of the security document 200 illustrated includes only the background image security feature 110. Each column 215 represents an individual spot (shown and described in additional detail in accordance with FIG. 3 below).

FIG. 2C illustrates a portion of the security document 200 where the background image security feature 110 and the printed data (e.g., the printed data 105 of FIG. 1) overlap. The surface of the laser reactive material 210, as shown in FIG. 2C, is darker than in either FIGS. 2A and 2B because of the overlapping of the printed data 105 and the background image security feature 110.

FIG. 2D illustrates a side view of the security document 200 including the core 205, the laser reactive material 210, and an optional protective layer 220. It is to be appreciated that the security document 200 can optionally include one or more additional layers.

The core 205 can be any of a variety of materials such as, but not limited to, polyvinyl chloride (PVC), acrylonitrile butadiene styrene (ABS), polyester, polypropylene, polycarbonate, other suitable thermoplastic materials, or combinations thereof.

In one embodiment, the thickness of the laser reactive material 210 can be from about 50 μm to about 200 μm. In another embodiment, the laser reactive material 210 can be from about 75 μm to about 150 μm in thickness. Commercially available laser reactive materials are sold under, for example, the trade name MAKROFOL® by Bayer Material Science LLC.

In some embodiments, the optional protective layer 220 can be a non-reactive layer that does not react/change when exposed to radiation from a laser. The optional protective layer 220 can have a thickness from about 10 μm to about 130 μm. In some embodiments, the thickness of the optional protective layer 220 can be from about 50 μm to about 100 μm. In some embodiments, when the optional protective layer 220 is a non-reactive layer, the area the laser marks may appear as a faint gray area without distinct spots. In some embodiments, however, if the optional protective layer 220 is a non-reactive layer that is thin (e.g., between about 10 μm and about 20 μm), the spots may be visible under magnification in reflected light. Commercially available materials for the optional protective layer 220 are sold under, for example, the trade name MAKROFOL® by Bayer Material Science LLC.

Figure 3:
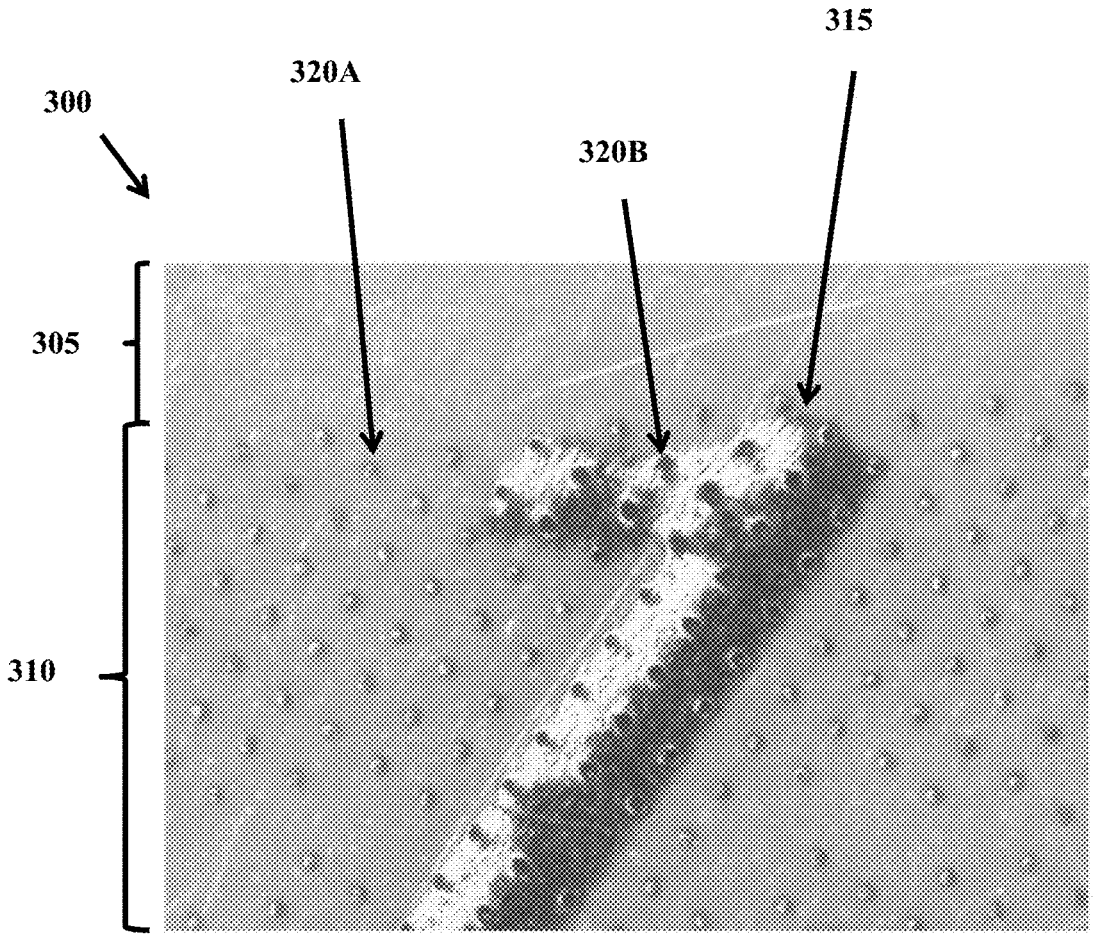
FIG. 3 illustrates a magnified view of a portion of a security document having a background image security feature (e.g., the background image security feature of FIG. 1), according to one embodiment.

FIG. 3 illustrates a magnified view of a portion of a security document 300 having a background image security feature (e.g., the background image security feature 110 of FIG. 1). The security document 300 includes a laser reactive material at the surface of the security document 300. When the laser reactive material is present near the surface of the security document 300, the area the laser marks (e.g., spots 320A and 320B) will feel smooth to the touch, but spots will be visible under magnification in reflected light. Alternatively, when the laser reactive material is not present near the surface of the security document 300 (e.g., a non-reactive material is present at the surface), the area the laser marks will still feel smooth to the touch, but spots 320B may not be visible under magnification in reflected light depending on the thickness of the non-reactive material at the surface (e.g., see FIG. 2D and its corresponding description). In such an embodiment, the laser marked area may appear as a faint gray without distinct spots.

As illustrated, the area 305 does not include any printed data 315 or the background image security feature 110. The area 310 includes the laser markings of the background image security feature 110. In the area 310, the background image security feature 110 and the printed data 315 overlap.

The spots 320A and 320B of the background image security feature vary depending on whether they overlap with the printed data 315. For example, the spots 320A (where the printed data 315 and the spots 320A do not overlap) are substantially similar and are rounded and geometrically smooth. In one embodiment, the spots 320A can be a different size and geometrical shape and can be varied, such as by varying the power of the laser, from spot to spot. The spots 320B (where the printed data 315 and the spots 320B overlap) are generally larger than the spots 320A and are less similar from each other (e.g., non-uniform). In one embodiment, the lack of uniformity of the spots 320B can increase the difficulty in duplicating or altering a security document and can provide additional security.

Figure 4:
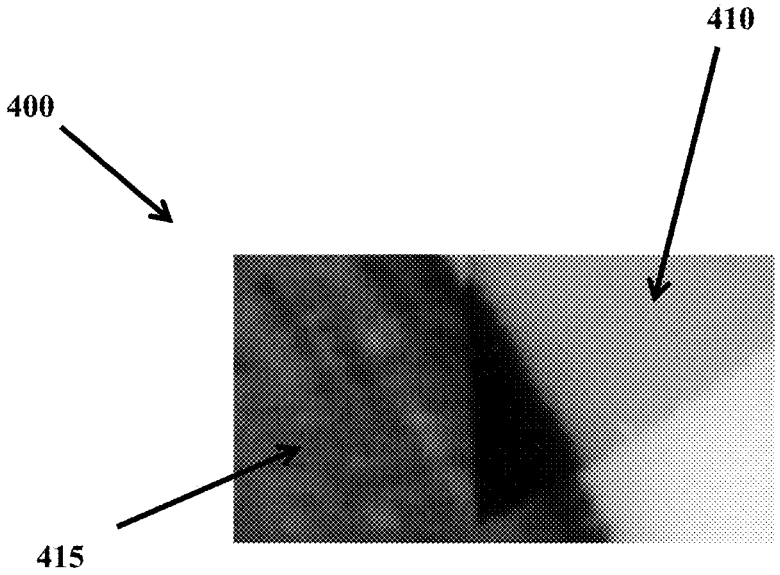
FIG. 4 illustrates a portion of a security document including a background security image feature, according to another embodiment.

FIG. 4 illustrates a portion of a security document 400 including a background image security feature 410 according to an alternative embodiment. The background image security feature 410 appears as a grayscale background element, rather than individual spots. Accordingly, where the background image security feature 410 and a printed data 415 overlap, the area of the overlap is illustrated as being darker than where the background image security feature 410 and the printed data 415 do not overlap. Further, the area of overlap may be slightly raised up, which can create randomly placed tactile portions of the security document 400. The background image security feature 410 may take longer to prepare than if dithering were used (e.g., FIG. 3 above) instead of grayscale for the background image security feature 410. The darkness of the background image security feature 410 is also critical, as when the background image security feature 410 is too dark, the printed data 415 can become difficult to read.

The terminology used in this Specification is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. A security document, comprising:

a plastic core and a laser reactive material on the plastic core, the laser reactive material comprises a material that reacts when exposed to radiation from a laser to create a darkening of the material that is contacted by the radiation;

printed data;

a plurality of spaced darkened spots integrally formed in the laser reactive material as a result of exposing portions of the laser reactive material to radiation from a laser, the spaced darkened spots are darker than adjacent material of the laser reactive material, wherein at least some of the spaced darkened spots and the printed data overlap one another and at least some of the spaced darkened spots do not overlap the printed data; and the spaced darkened spots are arranged to form an image, wherein the spaced darkened spots that overlap with the printed data vary in size from the spaced darkened spots that do not overlap the printed data.

2. The security document according to claim 1, wherein at least some of the plurality of spaced darkened spots are produced using different laser powers.

3. The security document according to claim 1, wherein the image is a portrait image.

4. The security document according to claim 1, wherein the image is alphanumeric text or characters.

5. The security document according to claim 1, wherein the spaced darkened spots include non-tactile microscopic bumps.

6. The security document according to claim 1, wherein the spaced darkened spots are at a resolution of between about 80 dots per inch to about 200 dots per inch.

7. A security document, comprising:

a plastic core and a laser reactive material on the plastic core, the laser reactive material comprises a material that reacts when exposed to radiation from a laser to create a darkening of the material that is contacted by the radiation;

printed data;

a plurality of spaced darkened spots integrally formed in the laser reactive material as a result of exposing portions of the laser reactive material to radiation from a laser, the spaced darkened spots are darker than adjacent material of the laser reactive material, wherein at least some of the spaced darkened spots and the printed data overlap one another and at least some of the spaced darkened spots do not overlap the printed data; and the spaced darkened spots are arranged to form an image, wherein the spaced darkened spots include tactile microscopic bumps.

8. A security document, comprising:

printed data;

a plurality of spaced darkened spots integrally formed in a layer of the security document, the spaced darkened spots are darker than material of the layer adjacent to the spaced darkened spots, wherein at least some of the spaced darkened spots and the printed data overlap one another and at least some of the spaced darkened spots do not overlap the printed data; and the spaced darkened spots are arranged to form an image, wherein the image is of an intended holder of the security document or of data that is personal to the intended holder of the security document, wherein the spaced darkened spots that overlap with the printed data vary in size from the spaced darkened spots that do not overlap the printed data.

9. The security document according to claim 8, wherein the security document includes a core and the layer disposed on the core; the layer comprises a laser reactive material, the laser reactive material comprises a material that reacts when exposed to radiation from a laser to create a darkening of the material that is contacted by the radiation; the plurality of spaced darkened spots being integrally formed in the laser reactive material.

10. The security document according to claim 8, wherein the plurality of spaced darkened spots are produced using a laser.

11. The security document according to claim 10, wherein at least some of the plurality of spaced darkened spots are produced using different laser powers.

12. The security document according to claim 8, wherein the spaced darkened spots include non-tactile microscopic bumps.

13. The security document according to claim 8, wherein the spaced darkened spots are at a resolution of between about 80 dots per inch to about 200 dots per inch.

14. A security document, comprising:

printed data;

a plurality of spaced darkened spots integrally formed in a layer of the security document, the spaced darkened spots are darker than material of the layer adjacent to the spaced darkened spots, wherein at least some of the spaced darkened spots and the printed data overlap one another and at least some of the spaced darkened spots do not overlap the printed data; and the spaced darkened spots are arranged to form an image, wherein the image is of an intended holder of the security document or of data that is personal to the intended holder of the security document, wherein the spaced darkened spots include tactile microscopic bumps.

15. A security document, comprising:

printed data;

a plurality of spaced darkened spots integrally formed in a layer of the security document, the spaced darkened spots are darker than material of the layer adjacent to the spaced darkened spots, wherein at least some of the spaced darkened spots and the printed data overlap one another and at least some of the spaced darkened spots do not overlap the printed data; and the spaced darkened spots are arranged to form an image, and the spaced darkened spots are at a resolution of between about 80 dots per inch to about 200 dots per inch;

wherein the spaced darkened spots that overlap with the printed data vary in size from the spaced darkened spots that do not overlap the printed data.

16. The security document according to claim 15, wherein the security document includes a core and the layer disposed on the core; the layer comprises a laser reactive material, the laser reactive material comprises a material that reacts when exposed to radiation from a laser to create a darkening of the material that is contacted by the radiation; the plurality of spaced darkened spots being integrally formed in the laser reactive material.

* * * * *